US008358221B2

(12) United States Patent
Ueno et al.

(10) Patent No.: US 8,358,221 B2
(45) Date of Patent: Jan. 22, 2013

(54) VEHICLE-MOUNTED DEVICE, OUTPUT PROPRIETY JUDGMENT METHOD, COMMUNICATION SYSTEM AND PROGRAM

(75) Inventors: Masahiro Ueno, Suginami-ku (JP); Yoshihito Kinoshita, Sagamihara (JP)

(73) Assignee: Kabushiki Kaisha Kenwood, Hachiouji-shi, Tokyo (JP)

( * ) Notice: Subject to any disclaimer, the term of this patent is extended or adjusted under 35 U.S.C. 154(b) by 356 days.

(21) Appl. No.: 12/808,430

(22) PCT Filed: Dec. 19, 2008

(86) PCT No.: PCT/JP2008/073154

§ 371 (c)(1),
(2), (4) Date: Jun. 16, 2010

(87) PCT Pub. No.: WO2009/081849

PCT Pub. Date: Jul. 2, 2009

(65) Prior Publication Data

US 2010/0277343 A1 Nov. 4, 2010

(30) Foreign Application Priority Data

Dec. 21, 2007 (JP) ..... 2007-331103

(51) Int. Cl.
*G08G 1/09* (2006.01)

(52) U.S. Cl. ..... 340/905; 340/995.13; 701/400

(58) Field of Classification Search ..... 340/905, 340/995.1, 995.12, 995.13, 996, 901, 995.27, 340/995.28; 701/201, 400, 428, 441
See application file for complete search history.

(56) References Cited

U.S. PATENT DOCUMENTS
(Continued)

FOREIGN PATENT DOCUMENTS

| | | |
|---|---|---|
| JP | 10-122870 | 5/1998 |
| JP | 2003-296883 | 10/2003 |
| WO | WO 2007/057696 | 5/2007 |

OTHER PUBLICATIONS

Notification of Transmittal of Translation of the International Preliminary Report on Patentability (Application No. PCT/JP2008/073154) dated Jul. 29, 2010).

(Continued)

*Primary Examiner* — Toan N Pham
(74) *Attorney, Agent, or Firm* — Eric J. Robinson; Robinson Intellectual Property Law Office, P.C.

(57) ABSTRACT

An utterance type vehicle-mounted device (200) is mounted on a vehicle traveling on a road and provided with a communication processing unit for receiving information from a roadside apparatus (100) set on a road side and an information reproduction unit (information output unit) for outputting the information received by the communication processing unit. The utterance type vehicle-mounted device (200) further includes a user input unit that inputs the following effect of information in the case where the information received from the roadside apparatus (100) and outputted by the information reproduction unit (information output unit) is specific information to be provided to the same direction as the vehicle travels or a different direction. Thus, vehicle-mounted device, an output propriety method, a road communication system, and a program that are not made to output traffic information or the like which is not directed to its own vehicle.

12 Claims, 12 Drawing Sheets

U.S. PATENT DOCUMENTS

| | | | | |
|---|---|---|---|---|
| 5,508,917 | A * | 4/1996 | Siegle et al. | 701/428 |
| 5,819,198 | A * | 10/1998 | Peretz | 701/117 |
| 5,839,086 | A * | 11/1998 | Hirano | 701/420 |
| 6,466,862 | B1 * | 10/2002 | DeKock et al. | 701/117 |
| 6,943,702 | B2 * | 9/2005 | Kato | 340/988 |
| 7,427,928 | B2 * | 9/2008 | Crocker et al. | 340/902 |
| 8,165,748 | B2 * | 4/2012 | Goto et al. | 701/36 |

OTHER PUBLICATIONS

International Search Report for Application U.S. Appl. No. PCT/JP2008/073154.

Supplementary European Search Report (Application No. 08865344.9) dated May 3, 2012.

* cited by examiner

VEHICLE-MOUNTED DEVICE, OUTPUT PROPRIETY JUDGMENT METHOD, COMMUNICATION SYSTEM AND PROGRAM

TECHNICAL FIELD

The present invention relates to a vehicle-mounted device, an output acceptability decision method, a road communication system, and a program.

BACKGROUND ART

Intelligent transport systems (hereafter referred to as "ITS") have been conceived and have started to be realized; the ITS is a new transport system configured to use a short range communication system called DSRC (Dedicated Short Range Communication; hereafter referred to as "DSRC") to solve road traffic problems such as traffic accidents and traffic jams. In the ITS, roadside apparatuses installed on a road broadcast information to vehicle-mounted devices mounted in vehicles. Each vehicle-mounted device provides traffic information received from the roadside apparatus to an occupant in the vehicle in the form of voice, still images, or text data at predetermined timings. Attempts have been made to configure roadside apparatuses used in the ITS such that the apparatuses provide vehicle-mounted devices with information varying between the inbound lane and outbound lane of the road. If such information varying between the inbound lane and the outbound lane is provided, traffic information for the inbound lane transmitted by the roadside apparatus may be received by a vehicle-mounted device mounted in a vehicle traveling in the outbound lane, because of leakage, irregular reflection, or the like of electric waves to output the traffic information. In a known technique to solve such a problem, an electric wave absorber is provided at a tollgate on a toll road; the electric wave absorber enables inhibition of the leakage, irregular reflection, or the like of electric waves transmitted by the roadside apparatus (see Patent Document 1).

Patent Document 1: Japanese Patent Application Laid-Open No. 2002-237719 (FIG. 1 and the like)

DISCLOSURE OF THE INVENTION

Problems to be Solved by the Invention

The technique described in Patent Document 1 is used for a roadside apparatus in an ETC system provided at an expressway tollgate. According to the technique, the electric wave absorber may be provided in the tollgate. Thus, costs and an installation site do not need to be particularly taken into account. However, for the roadside apparatus used in the ITS, not all the roadside apparatuses have corresponding tollgates. Appropriate installation sites cannot be provided for all the electric wave absorbers. Furthermore, enormous amounts of time and money are required to ensure appropriate installation costs and site for the electric wave absorber, for all the roadside apparatuses. This is not practical. Thus, a new technique for the ITS needs to be provided which prevents output of traffic information or the like not directed to the own vehicle and resulting from the leakage, irregular reflection, or the like of electric waves transmitted by the roadside apparatus.

The present invention has been developed in view of the above-described problems. An object of the present invention is to provide a vehicle-mounted device, an output acceptability decision method, a road communication system, and a program all of which are designed to prevent output of traffic information and the like not directed to the own vehicle.

Means for Solving the Problems

To accomplish the above-described object, a first aspect of the present invention provides a vehicle-mounted device mounted in a vehicle traveling on a road and including a communication processing unit configured to receive information from the roadside apparatus installed on a road, and an information output unit configured to output the information received by the communication processing unit, the vehicle-mounted device being characterized by further including a user input unit configured such that if information received from the roadside apparatus and outputted through the information output unit is to be provided for the same direction as a vehicle traveling direction or for a direction different from the vehicle traveling direction, the user input unit is used to provide an input indicating that the information received from the roadside apparatus and outputted through the information output unit is to be provided for the same direction as the vehicle traveling direction or for a direction different from the traveling direction.

The vehicle-mounted device according to the present invention is characterized by further including a direction information determination unit configured to associate direction information provided via the user input unit with direction information included in the received information to determine the vehicle traveling direction, a direction information storage unit configured such that the direction information determined by the direction information determination unit is recorded in the direction information storage unit, and an output acceptability determination unit configured such that depending on whether or not the direction information recorded in the direction information storage unit coincides with direction information included in information received after the recording of the direction information in the direction information storage unit, the output acceptability determination unit decides whether or not to output the received information through the information output unit.

The vehicle-mounted device according to the present invention is characterized in that after the information output unit outputs the received information, the user input unit receives within a predetermined time, a decision input (A) indicating that the information is to be provided for the same direction as the vehicle traveling direction, or a decision input (B) indicating that the information is to be provided for a direction different from the vehicle traveling direction, and when the decision input (A) is received within the predetermined time or when no decision input is received within the predetermined time, the vehicle-mounted device decides that the input corresponds to (A), and when the decision input (B) is received within the predetermined time, the vehicle-mounted device decides that the input corresponds to (B).

The vehicle-mounted device according to the present invention is further characterized in that when the received information includes no direction information, the received information is directly outputted through the information output unit without determination of the direction information.

The vehicle-mounted device according to the present invention is further characterized in that when no information or no decision input is received within a predetermined time from the last information reception, the direction information determination unit deletes the direction information recorded in the direction information storage unit.

The vehicle-mounted device according to the present invention is further characterized in that when no direction information is recorded in the direction information storage unit, the received information is directly outputted through the information output unit.

The vehicle-mounted device according to the present invention is further characterized in that the vehicle-mounted device is a utterance type vehicle-mounted device that in capable of acquiring vehicle position information from a GPS apparatus or a vehicle speed sensor.

A second aspect of the present invention provides an output acceptability decision method used for a vehicle-mounted device mounted in a vehicle traveling on the road and including a communication processing unit configured to receive information from the roadside apparatus installed on a road, and an information output unit configured to output the information received by the communication processing unit, the output acceptability decision method being characterized by including a step of receiving an input indicating that the information received from the roadside apparatus and then outputted is to be provided for the same direction as a vehicle traveling direction or for a direction different from the traveling direction, a step of associating the input direction with direction information included in the received information to determine the vehicle traveling direction, a step of recording the determined direction information, and a step of, depending on whether or not the recorded direction information coincides with direction information included in information received after the recording of the direction information, deciding whether or not to output the information received after the recording of the direction information.

A third aspect of the present invention provides a road communication system including a vehicle-mounted device mounted in a vehicle, a roadside apparatus configured to transmit information including direction information to the vehicle-mounted device, and an information provision server configured to transmit the information including the direction information to the roadside apparatus, the road communication system being characterized in that the vehicle-mounted device includes a communication processing unit configured to receive information from the roadside apparatus, an information output unit configured to output the information received by the communication processing unit, a user input unit configured such that if the information outputted through the information output unit is to be provided for the same direction as a vehicle traveling direction or for a direction different from the vehicle traveling direction, the user input unit is used to provide an input indicating that the information received from the roadside apparatus and outputted through the information output unit is to be provided for the same direction as the vehicle traveling direction or for a direction different from the traveling direction, a direction information determination unit configured to associate direction information provided via the user input unit with direction information included in the received information to determine the vehicle traveling direction, a direction information storage unit configured such that the direction information determined by the direction information determination unit is recorded in the direction information storage unit, and an output acceptability determination unit configured such that depending on whether or not the direction information recorded in the direction information storage unit coincides with direction information included in information received after the recording of the direction information in the direction information storage unit, the output acceptability determination unit decides whether or not to output the information received after the recording of the direction information in the direction information storage unit, through the information output unit.

A fourth aspect of the present invention provides a program for allowing a computer to function as one of the above-described vehicle-mounted devices.

Effects of the Invention

The present invention can provide a vehicle-mounted device, an output acceptability decision method, a road communication system, and a program all of which are designed to prevent output of traffic information and the like not directed to the own vehicle.

DESCRIPTION OF REFERENCES

100 Roadside apparatus, 200 utterance type vehicle-mounted device (vehicle-mounted device), 212 Communication processing unit, 252 Utterance acceptability decision unit (output acceptability decision unit), 253 Information reproduction unit (information output unit), 254 Direction information determination unit, 255 User input unit, 256 Direction information storage unit, 300 Information provision server

BEST MODES FOR CARRYING OUT THE INVENTION

An embodiment of the present invention will be described taking a road communication system as an example. The embodiment of the present invention will be described taking, as an example, a vehicle-mounted device mounted in a vehicle, particularly an utterance type vehicle-mounted device configured to reproduce audio information. However, the present invention can also be utilized in a vehicle-mounted device assumed to be appropriately connected to a navigation apparatus. The present invention can also be utilized if the navigation apparatus is of a portable, simplified type including no acceleration sensor or vehicle speed pulse.

Figure 1:
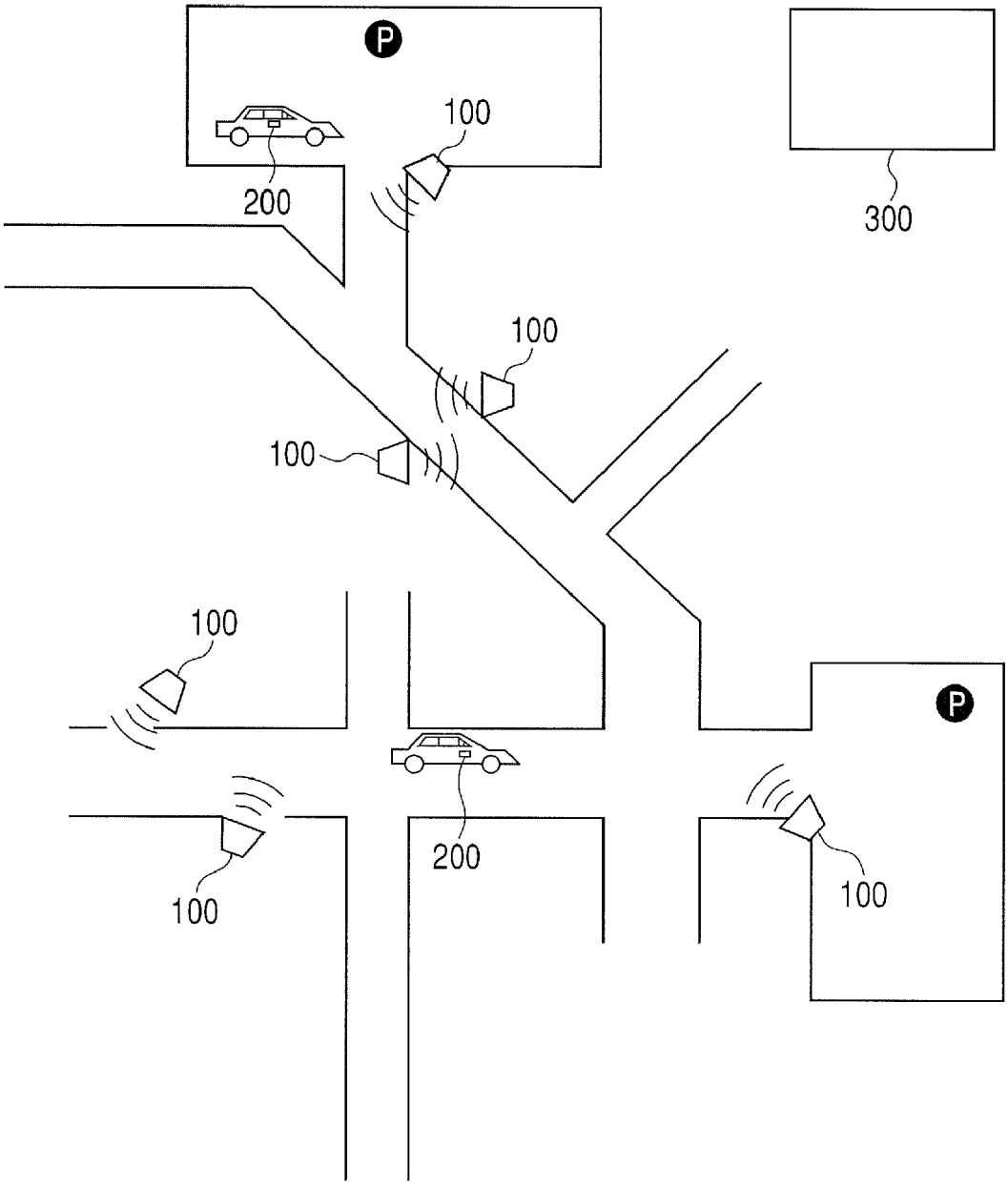
FIG. 1 is a diagram of the general configuration of a road communication system according to an embodiment of the present invention.

FIG. 1 is a diagram of the general configuration of a road communication system according to the embodiment of the present invention. As shown in FIG. 1, the road communication system includes roadside apparatuses 100 installed near sites such as roads and parking lots on or in which vehicles travel, utterance type vehicle-mounted devices 200 (vehicle-mounted device) mounted in the vehicles to communicate with the roadside apparatuses 100 in a short range based on DSRC to provide audio information such as traffic information and safe driving support information which is to be transmitted to drivers or the like, and an information provision server 300 configured to supply the information described above to the roadside apparatuses 100.

The roadside apparatus 100 shown in FIG. 1 utilizes what is called an electric wave beacon or an optical beacon to perform DSRC-based short range communication with the utterance type vehicle-mounted device 200 in a directional, particular communication area; the vehicle-mounted device 200 mounted in a vehicle traveling on an expressway or the like. Each roadside apparatus 100 receives audio information and reproduction control information to be transmitted, from the information provision server 300 to store the information. The information provision server 300 and each roadside apparatus 100 are connected together via an ITS communication network NW2 (see FIG. 3).

(Description of the General Configuration of the Road Communication System)

Figure 2:
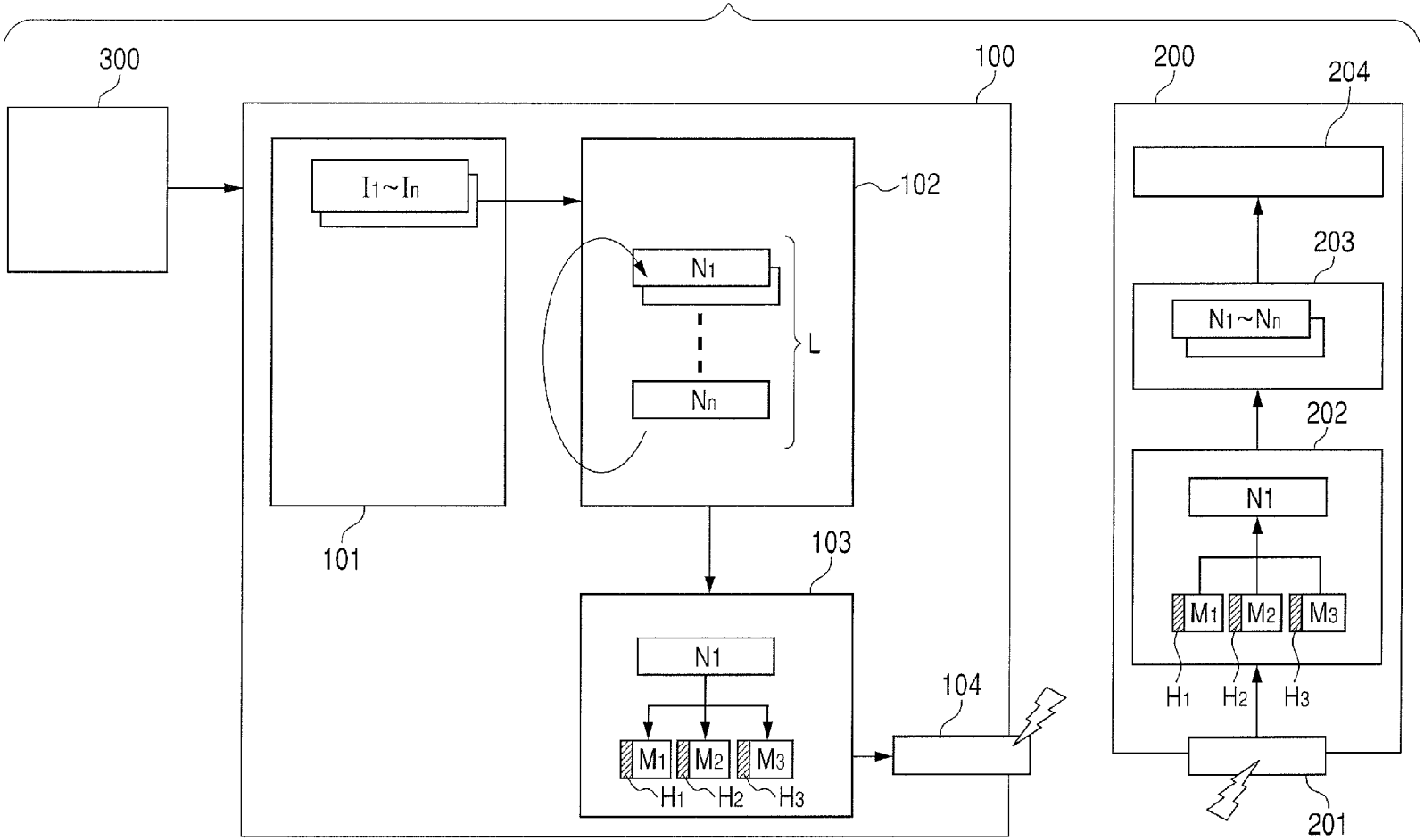
FIG. 2 is a diagram schematically showing the relationship between a roadside apparatus and an utterance type vehicle-mounted device and an information provision server all of which are main hardware in the road communication system, and communication processing based on DSRC.

FIG. 2 is a diagram schematically showing the relationship between the roadside apparatus 100 and the utterance type vehicle-mounted device 200 and the information provision server 300 all of which are main hardware in the road communication system, and communication processing based on DSRC. The roadside apparatus 100 installed on a roadside repeatedly broadcasts a plurality of pieces of audio information provided by the information provision server 300, to the utterance type vehicle-mounted device 200 mounted in the vehicle passing through the communication area.

The roadside apparatus 100 includes an information update unit 101, a cyclic unit 102, a divided transmission unit 103, and a communication processing unit 104 in order to sequentially broadcast the audio information to the utterance type vehicle-mounted device 200.

The information update unit 101 provides a function to add/update the plurality of pieces of audio information provided by the information provision server 300 to an audio information list held by the roadside apparatus 100. For example, as shown in FIG. 2, upon receiving a plurality of pieces of content update information $I_1$ to $I_n$ from the information provision server 300, the information update unit 101 compares the content update information $I_1$ to $I_n$ with a currently provided audio information list L to check for audio information to be updated. If the audio information is absent and if the audio information list is to be updated to the content update information, the information update unit 101 executes a process of adding and updating the audio information.

The cyclic unit 102 provides a function to select audio information to be transmitted, from the audio information list L held by the roadside apparatus 100 to notify the divided transmission unit 103 of the selected audio information. For example, it is assumed that the audio information list L held by the roadside apparatus 100 contains pieces of audio information N1 to $N_n$ as shown in FIG. 2. The cyclic unit 102 selects the piece of audio information N1 from the audio information in the list as audio information to be transmitted and notifies the divided transmission unit 103 of the piece of audio information N1. In principle, the cyclic unit 102 sequentially processes the pieces of audio information N1 to $N_1$ held in the audio information list L, starting with the leading piece of information.

The divided transmission unit 103 divides the audio information received from the cyclic unit 102 into predetermined units to create divided information. Then, the divided transmission unit 103 newly adds divided header information to header information in the divided information to create transmission information to be broadcast to within a particular communication area. For example, the divided transmission unit 103 divides the piece of audio information N1 selected by the cyclic unit 102 into pieces of divided information $M_1$ to $M_3$, and adds pieces of divided header information $H_1$ to $H_3$ to the respective pieces of header information in the corresponding pieces of divided information. Thereafter, the communication processing unit 104 sequentially converts the pieces of divided information with the respective pieces of divided header information added thereto into radio signals or optical signals. The communication processing unit 104 then transmits the signals.

Now, the operation of the utterance type vehicle-mounted device 200 which received the information transmitted by the roadside apparatus 100 will be described. As shown in FIG. 2, the utterance type vehicle-mounted device 200 includes a communication processing unit 201, a divided information reorganization unit 202, a reproduction control unit 203, and an audio information reproduction unit 204.

The communication processing unit 201 provides a function to receive the divided information transmitted by the roadside apparatus 100. The divided information reorganization unit 202 provides a function to sequentially reorganize the pieces of divided information $M_1$ to $M_3$ received by the communication processing unit 201 into the original information N1 based on the pieces of divided header information $H_1$ to $H_3$ added to the respective pieces of divided information $M_1$ to $M_3$. The reproduction control unit 203 provides a function to control the order in which the received pieces of audio information are outputted. The audio information reproduction unit 204 provides a function to reproduce the audio information under the control of the reproduction control unit 203.

(Description of the Hardware Configuration of the Roadside Apparatus and the Operation of Each Unit of the Roadside Apparatus)

Figure 3:
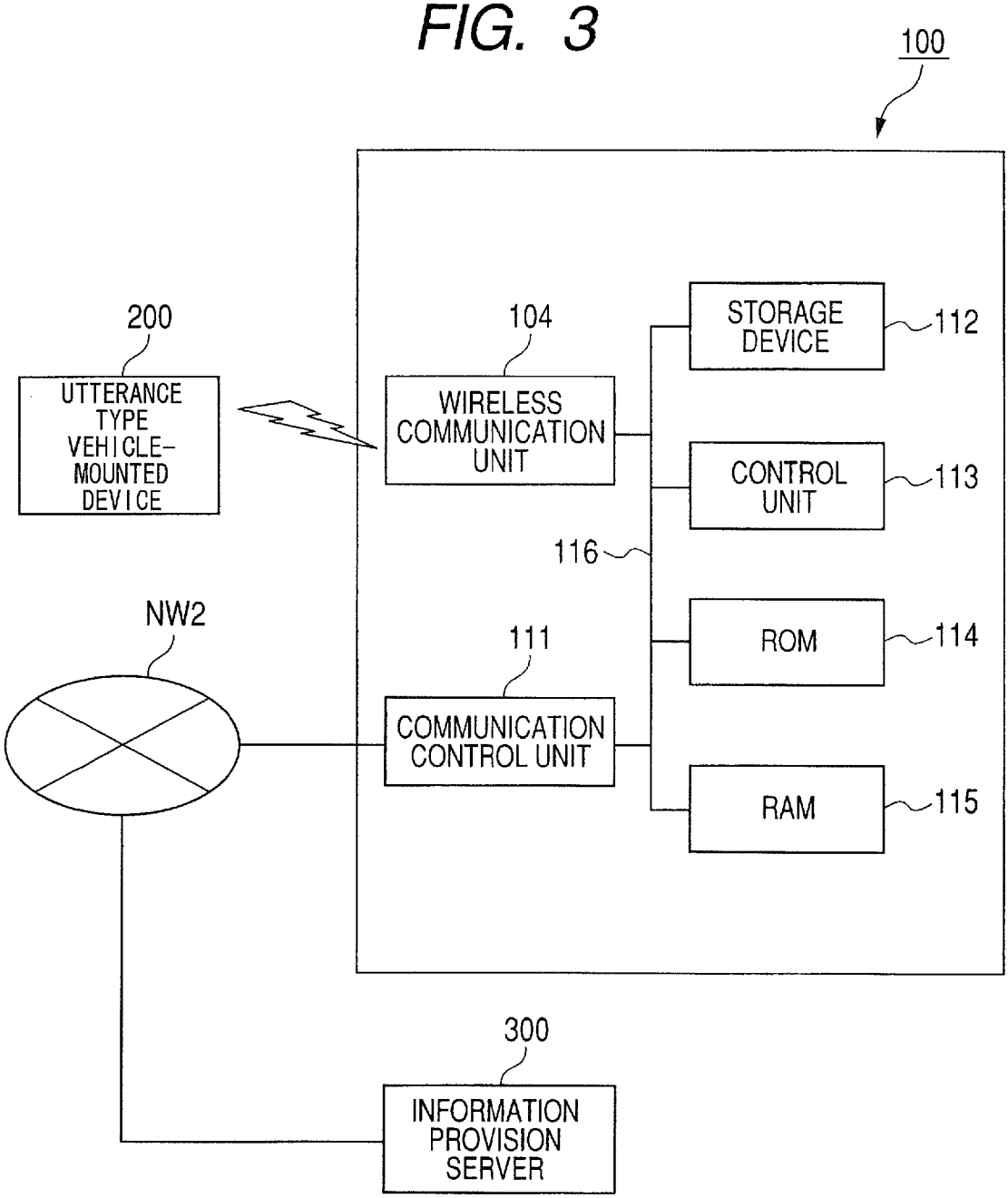
FIG. 3 is a diagram showing the hardware configuration of the roadside apparatus installed on a road in the road communication system in FIG. 1.

Now, the hardware configuration of the roadside apparatus 100 will be described with reference to FIG. 3. FIG. 3 is a diagram showing the hardware configuration of the roadside apparatus 100 installed on the road in the road communication system in FIG. 1. The hardware of the roadside apparatus 100 includes, in addition to the above-described wireless communication unit 104, a communication control unit 111, a storage device 112, a control unit 113, a ROM (Read Only Memory) 114, a RAM (Random Access Memory) 115, and a system bus 116.

The wireless communication unit 104 provides an information update function, a cyclic function, and a divided transmission function. Furthermore, the wireless communication unit 104 uses these functions to communicate traffic information provided by the information provision server 300 with the utterance type vehicle-mounted device 200 installed in the passing vehicle, via radio signals such as electric wave signals or optical signals.

The communication control unit 111 receives audio information transmitted by the information provision server 300. The storage device 112 provides a function to store, for example, the traffic information received from the information provision server 300 and traffic information specific to the own vehicle. The control unit 113 includes a processor such as a CPU (Central Processing Unit) to control the roadside apparatus 100 as a whole. In particular, the control unit 113 provides a function to transmit the traffic information stored in the storage device 112 from the wireless communication unit 104 and to store information acquired via the wireless communication unit 104, in the storage device 112. Furthermore, the control unit 113 provides a function to transmit the traffic information acquired by the apparatus and stored in the storage device 112, to the information provision server 300 via the communication control unit 111 and the ITS communication network NW2 and to store the information acquired from the information provision server 300 via the communication control unit 111, in the storage device 112.

The ROM 114 provides a function to store an OS (Operating System) and various pieces of information required to control the operation of the roadside apparatus 100 as a whole. The RAM 115 functions as a work area (an area for arithmetic processing) for the control unit 113. The system bus 116 functions as a transmission path through which commands and information are transferred among the units.

(Description of the Hardware Configuration of the Utterance Type Vehicle-Mounted Device and the Operation of Each Unit of the Device)

Figure 4:
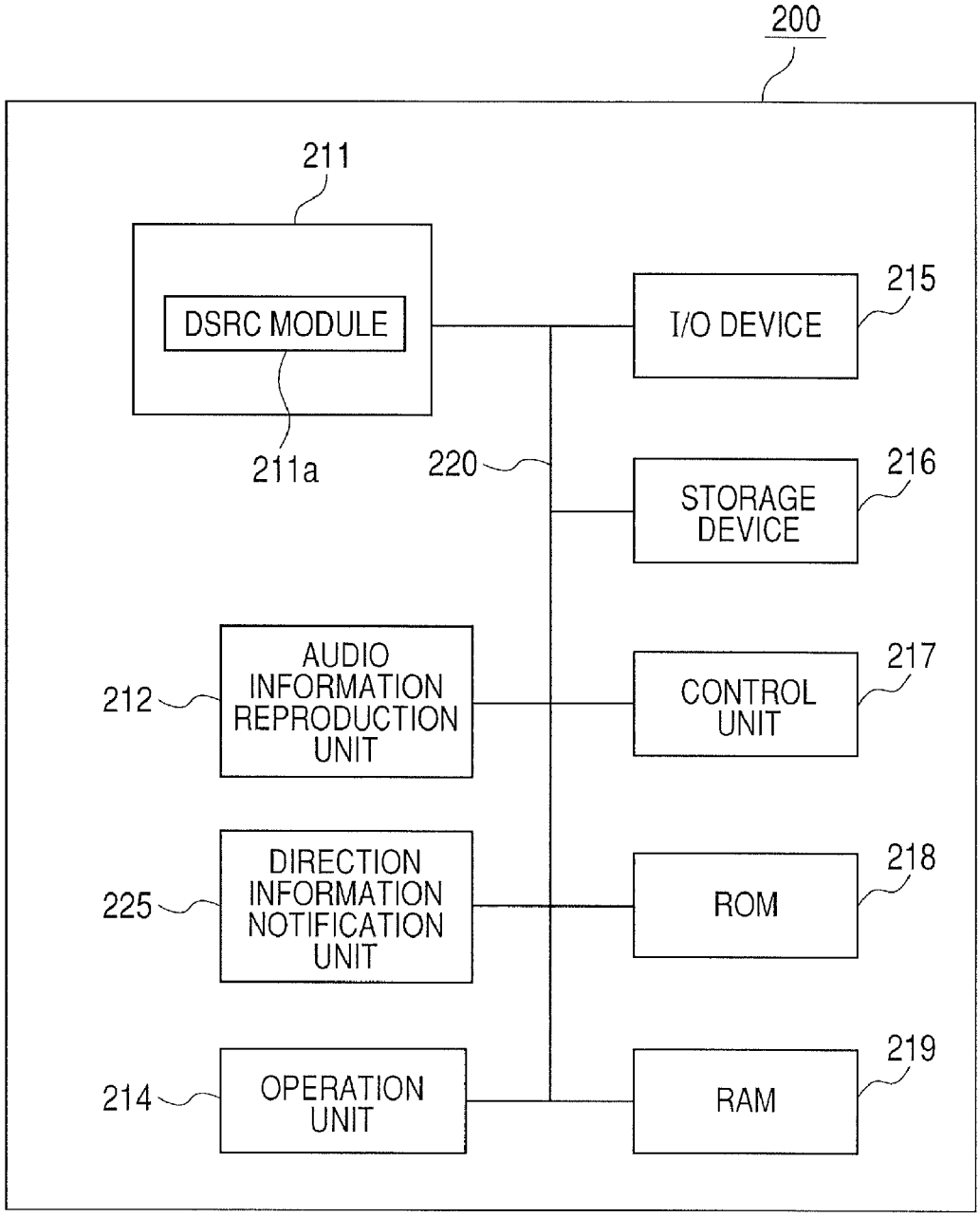
FIG. 4 is a diagram showing the configuration of the utterance type vehicle-mounted device mounted in each vehicle in the road communication system in FIG. 1.

Now, the hardware configuration of the utterance type vehicle-mounted device 200 and the operation of each unit of the utterance type vehicle-mounted device 200 will be described mainly with reference to FIG. 4. FIG. 4 is a diagram showing the configuration of the utterance type vehicle-mounted device 200 mounted in each vehicle in the road communication system shown in FIG. 1. The utterance type vehicle-mounted device 200 is a simple utterance type vehicle-mounted device that does not use any means capable of detecting information on the position where the vehicle is traveling or any position information on the roadside apparatus 100. Furthermore, the utterance type vehicle-mounted device 200 has no general car navigation functions. Additionally, the utterance type vehicle-mounted device 200 does not have a function to display various pieces of image information including traffic information transmitted by the roadside apparatus 100, but provides a function to simply notify the driver only of the audio information transmitted by the roadside apparatus 100.

As shown in FIG. 4, the utterance type vehicle-mounted device 200 includes a communication processing unit 211, an audio information reproduction unit 212, an operation unit 214, an I/O (Input/Output) device 215, a storage device 216, a control unit 217, a ROM 218, a RAM 219, a system bus 220, and a user input unit 255.

The communication processing unit 211 has the functions of the communication processing unit 201 and divided information reorganization unit 202 shown in FIG. 2. The communication processing unit 211 includes a DSRC module 211*a*.

The DSRC module 211*a* communicates with the roadside apparatus 100 via an antenna (not shown in the drawings) in accordance with the DSRC scheme. The DSRC module 211*a* executes the functions of the above-described divided information reorganization unit 202. Specifically, the DSRC module 211*a* reorganizes the transmitted divided information and processes the resulting information.

The audio information reproduction unit 212 converts a digital audio signal received from the control unit 217 into an analog audio signal via a D/A converter (not shown in the drawings) and outputs the analog audio signal to a speaker (not shown in the drawings).

The operation unit 214 includes a touch panel-type input device. The operation unit 214 generates an indication input signal based on an indication input from the user and inputs the signal to the control unit 217. The I/O device 25 reads out received audio information and inputs it to the control unit 217. The storage device 216 includes an HDD (Hard Disk Drive) and stores various pieces of setting information and the like. The storage device 216 may include any other memory such as a memory card. The control unit 217 includes a CPU (Central Processing Unit) to control the utterance type vehicle-mounted device 200 as a whole. For example, the control unit 217 receives traffic information from the roadside apparatus 100 via the DSRC module 211*a*. The control unit 217 then auditorially reproduces the traffic information based on reproduction timing control information (parameter) included in the received traffic information. The control unit 217 may include a coprocessor.

OS programs and various pieces of information required to control the operation of the utterance type vehicle-mounted device 200 as a whole are recorded in the ROM 218. The RAM 219 is configured to temporarily store information and programs and to hold audio information and the like acquired by the communication processing unit 211. Furthermore, the control unit 217 uses the RAM 219 as a work memory (an area for arithmetic processing). The system bus 220 is a transmission path configured to connect the above-described units together to allow commands and information to be transferred. The description of the user input unit 255 is included in the description below of functional components.

Figure 5:
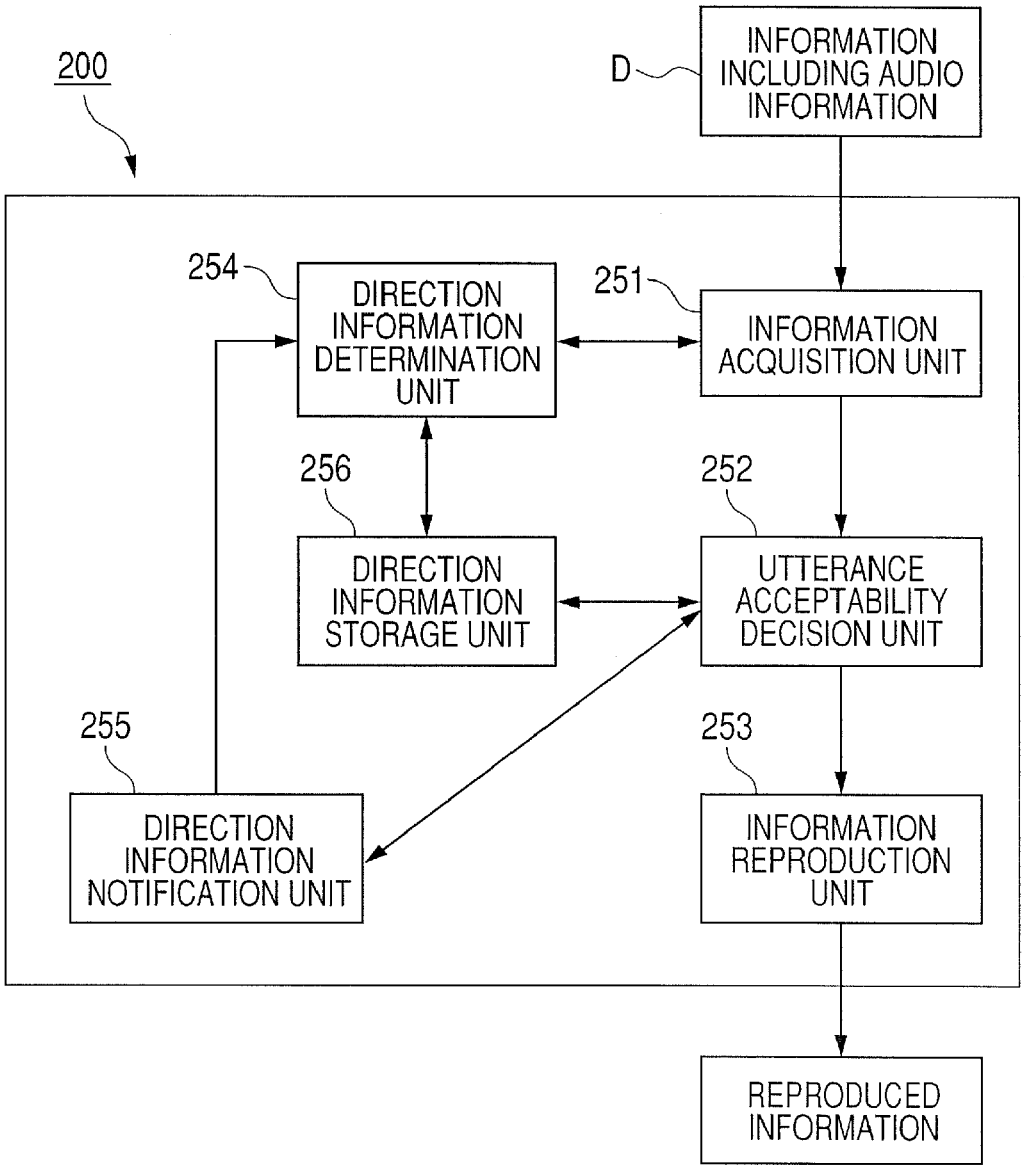
FIG. 5 is a diagram illustrating the functions of the utterance type vehicle-mounted device shown in FIG. 1.

The utterance type vehicle-mounted device 200 can be divided as shown in FIG. 5 in terms of functions. FIG. 5 is a diagram illustrating the functions of the utterance type vehicle-mounted device 200 shown in FIG. 1. The utterance type vehicle-mounted device 200 includes an information acquisition unit 251, an utterance acceptability decision unit 252 (output acceptability decision unit), an information reproduction unit 253 (information output unit), a direction information determination unit 254, a user input unit 255, and a direction information storage unit 256. Each of the information acquisition unit 251, utterance acceptability decision unit 252, information reproduction unit 253, direction information determination unit 254, user input unit 255, and direction information storage unit 256 is configured to operate in cooperation with the control unit 217, the communication processing unit 211, the storage device 216, and the like, shown in FIG. 4.

The information acquisition unit 251 provides a function to acquire information D including one or more pieces of audio information to be reproduced, from the roadside apparatus 100. For example, the information D includes such information items as shown below in Table 1. With reference to Table 1, the information items will be sequentially described starting with the top item in the table.

The traffic information type is information indicative of the type of traffic information. The traffic information type includes, for example, disaster information indicative of a natural disaster such as an earthquake, safe driving support information alerting the driver to a forward merging traffic, and general traffic information indicating a traffic jam or the like. The roadside apparatus ID is an ID that allows the roadside apparatus 100 to be uniquely discriminated from the other roadside apparatuses 100. The road type is information indicative of the type of the road. For example, the road type includes an expressway, a general road, a toll road, a general national road, and a main local road. The lane type is information used to distinguish the lanes of the road from each other. Table 1 shown below contains information item indicative of an inbound lane and an outbound lane and an information item indicative of a belt line (inbound and outbound). However, not both pieces of information need to be provided. The orientation information is direction information (hereafter referred to as "direction information") indicative of the traveling direction of a vehicle traveling on the road. The direction information indicates, for example, four orientations, that is, north, south, east, and west, or eight or sixteen orientations. If the traffic information type is, for example, the disaster information, the direction information is not generally provided because the disaster information needs to be conveyed to all the drivers driving on the road. However, for the safety driving support information and the general traffic information, the direction information is generally provided because the safety driving support information and the general traffic information need to be conveyed to the drivers driving in a particular lane. The route number is a number allowing the road to be uniquely discriminated from the other roads. These pieces of information (hereafter referred to as "attribute information") are indicative of attributes determining the acceptability of output of text information, a still image, or audio information (hereafter these pieces of information are called "content information"), the precedence of the information, and the like. The content information includes the contents of the disaster information, the safe driving support information, the general traffic information, commercial multipurpose information, or the like. Audio information is provided, for example, in a TTS (Text-To-Speech) format. These pieces of content information may include one or more pieces of traffic information. Furthermore, whether or not the attribute information is added is determined depending on the content information.

TABLE 1

| |
|---|
| Traffic information type |
| Roadside apparatus ID |
| Road type |
| Lane type (inbound and outbound) |
| Lane type (belt line) |
| Orientation information |
| Route number |
| Text information |
| Still image information |
| Audio information |

The information acquisition unit 251 provides a function to reorganize and decode pieces of divided information D received from the communication processing unit 211 and including audio information or to read out and acquire the information stored in the storage device 216 at a predetermined timing.

The utterance acceptability decision unit 252 (output acceptability decision unit) provides a function to decide whether or not to output the audio information acquired by the information acquisition unit 251. The utterance acceptability decision unit 252 decides whether or not the utterance can be outputted by comparing the direction information included in the received information D with the direction information recorded in the direction information storage unit 256 described below. Alternatively, the utterance acceptability decision unit 252 may decide whether or not the utterance of the relevant audio information can be outputted, based on a notification from the direction information determination unit 254 described below.

The information reproduction unit 253 (information output unit) provides a function corresponding to the audio information reproduction unit 204 shown in FIG. 2 and the audio information reproduction unit 212 shown in FIG. 4, that is, the function to reproduce audio information. The information reproduction unit 253 provides a function to reproduce audio information based on the decision result from the utterance acceptability decision unit 252. Furthermore, the information reproduction unit 253 may stop reproduction of audio information in response to an interruption process executed by the user input unit 255 described below. Additionally, if a plurality of pieces of audio information need to be reproduced, the information reproduction unit 253 may control the order of reproduction according to the precedence of the respective pieces of audio information. For example, if three types of audio information, the disaster information, the safe driving support information, and the general traffic information, need to be reproduced, the precedence may be preset in order of the disaster information, the safe driving support information, and the general traffic information. Then, the reproduction order can be controlled based on this setting.

The direction information determination unit 254 provides a function to determine the traveling direction of the utterance type vehicle-mounted device 200 based on the traveling direction of the utterance type vehicle-mounted device 200 and information on the direction for which the audio information transmitted by the roadside apparatus 100 is to be provided. Furthermore, the direction information determination unit 254 provides a function to record the determined direction information in the direction information storage unit 256. Additionally, the direction information determination unit 254 can directly notify the utterance acceptability decision unit 252 of the determined direction information.

The user input unit 255 provides a function to notify the direction information determination unit 254 of the direction information. Furthermore, the user input unit 255 provides a function to accept a decision input from the driver after an audio reproduction process executed by the information reproduction unit 253. Additionally, the user input unit 255 provides a function to notify the direction information determination unit 254 of the result of acceptance of the decision input.

Figure 6:
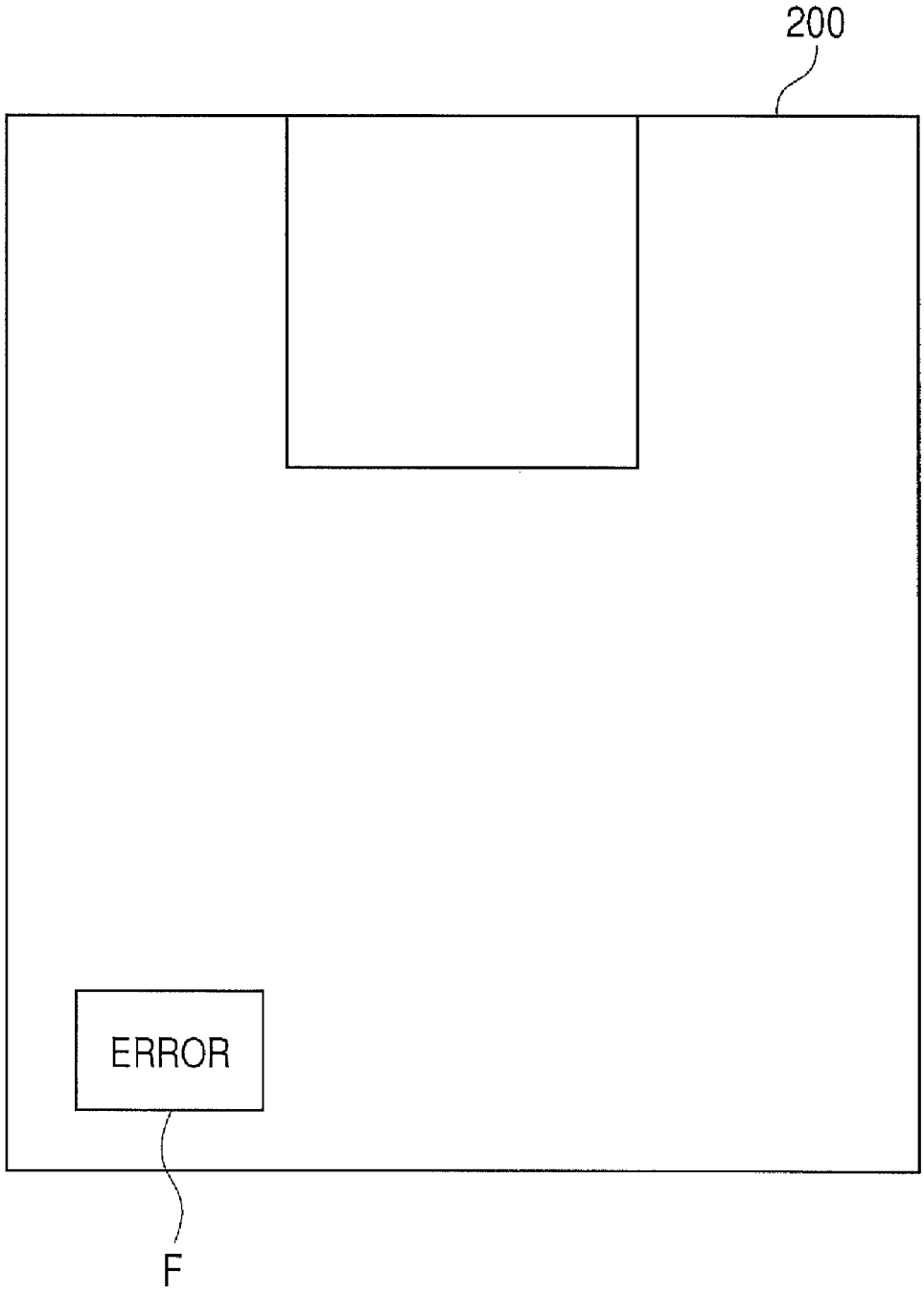
FIG. 6 is a diagram showing a first configuration example of a user input unit shown in FIG. 5.

FIG. 6 is a diagram showing a first configuration example of the user input unit 255. The user input unit 255 includes a user input button F (user input unit 255) allowing information indicating that the information is false to be input to the utterance type vehicle-mounted device 200. When the driver depresses the user input button F, the direction information determination unit 254 can be notified that audio information with error direction information has been uttered. The user input button F may be used to confirm that the audio information is to be uttered for the same direction as the traveling direction of the own vehicle. Alternatively, another specific example of the user input unit 255 may be a user input remote controller or a communication instrument including a user input function so that the user can operate the user input remote controller or the communication instrument to provide the above-described decision input. Alternatively, in the present embodiment, the user input unit 25.5 may allow direction information to be input directly through the driver's voice.

The direction information storage unit 256 provides a function to record the direction information on the vehicle with the utterance type vehicle-mounted device 200 mounted therein.

The direction information storage unit 256 also provides a function to record the direction information inputted via the user input unit 255.

(Description of the Hardware Configuration of the Information Provision Server and the Operation of Each Unit of the Information Provision Server)

Figure 7:
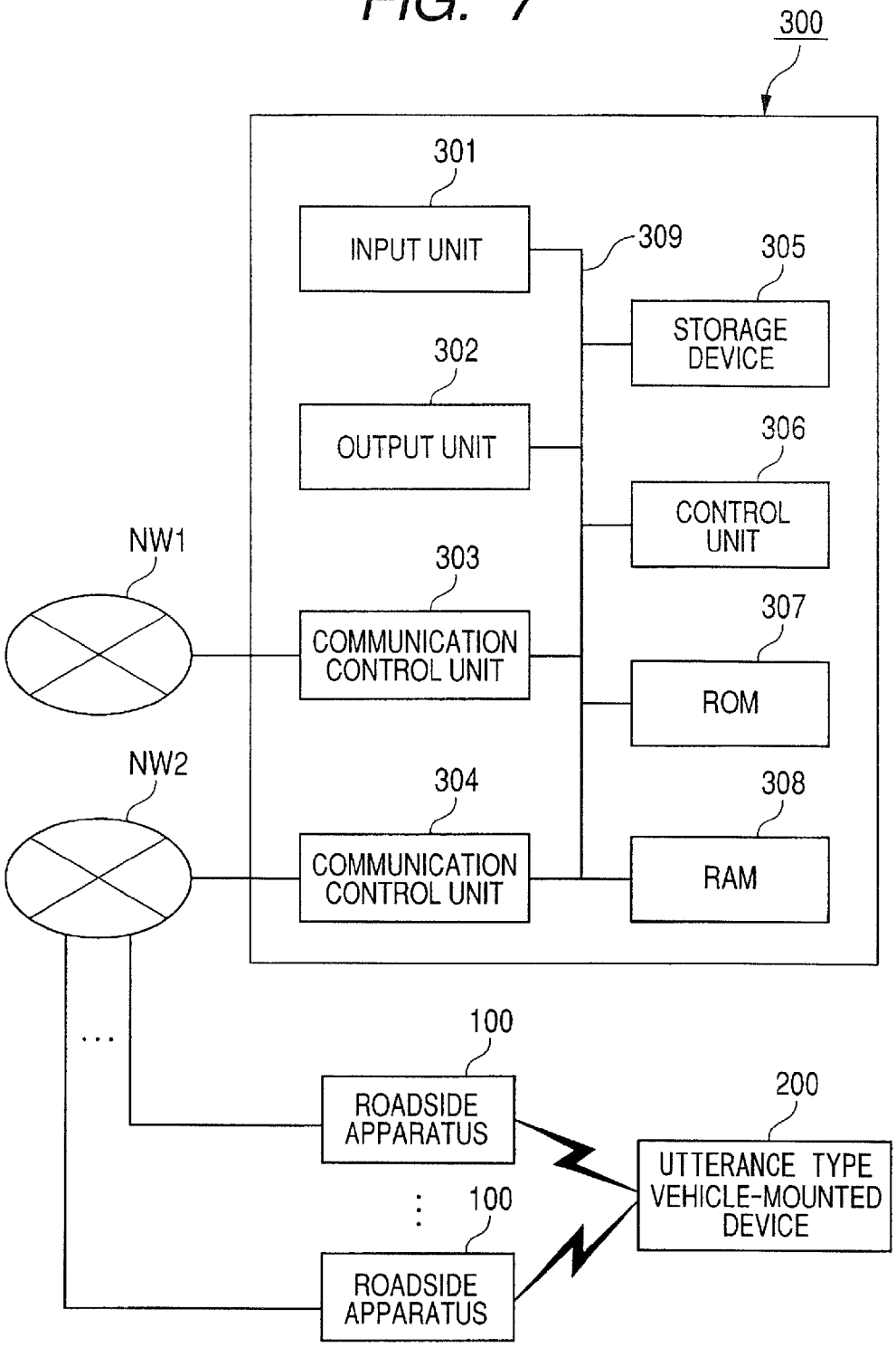
FIG. 7 is a diagram showing a configuration example of the information provision server shown in FIG. 1.

Now, the hardware configuration of the information provision server 300 and the operation of each unit of the information provision server 300 will be described with reference to FIG. 7. FIG. 7 is a diagram showing an example of the configuration of the information provision server 300 shown in FIG. 1. The information provision server 300 is an apparatus configured to generate and distribute traffic information and the like for each roadside apparatus 100. The information provision server 300 includes an input unit 301, a display unit 302, communication control units 303 and 304, a storage device 305, a control unit 306, a ROM 307, a RAM 308, and a system bus 309.

The input unit 301 includes one or more of a keyboard, a mouse, an input interface, and the like to input various pieces of information and instructions. The display unit 302 includes a display device or the like to display information, messages and the like.

The first communication control unit 303 communicates with external apparatuses via a general communication network NW1 such as a telephone line or the Internet to acquire various pieces of information. The second communication control unit 304 is connected to a plurality of roadside apparatus 100 via an ITS communication network NW2 to transmit traffic information to each of the roadside apparatuses 100. The second communication control unit 304 collects information obtained by the roadside apparatus 100 through communication with the utterance type vehicle-mounted device 200.

The storage device 305 includes a hard disk device to store various pieces of traffic information. The storage device 305 is also configured to store the position, address, and the like of each roadside apparatus 100 and geographical information on the vicinity of the roadside apparatus 100.

The control unit 306 includes a processor to control the operation of the information provision server 300 as a whole. Furthermore, based on the various pieces of information stored in the storage device 305, the control unit 306 creates information to be distributed to each roadside apparatus 100 from the vicinity of the roadside apparatus 100. The control unit 306 then supplies the information to the roadside apparatus 100 via the second communication control unit 304 and the ITS communication network NW2.

The ROM 307 is configured to store an OS (Operating System) and various pieces of information required to control the operation of the information provision server 300 as a whole. The RAM 308 functions as a work area for the control unit 306. The system bus 309 is a transmission path through which commands and information are transferred among the units.

(Description of a First Utterance Acceptability Decision Process)

Figure 8:
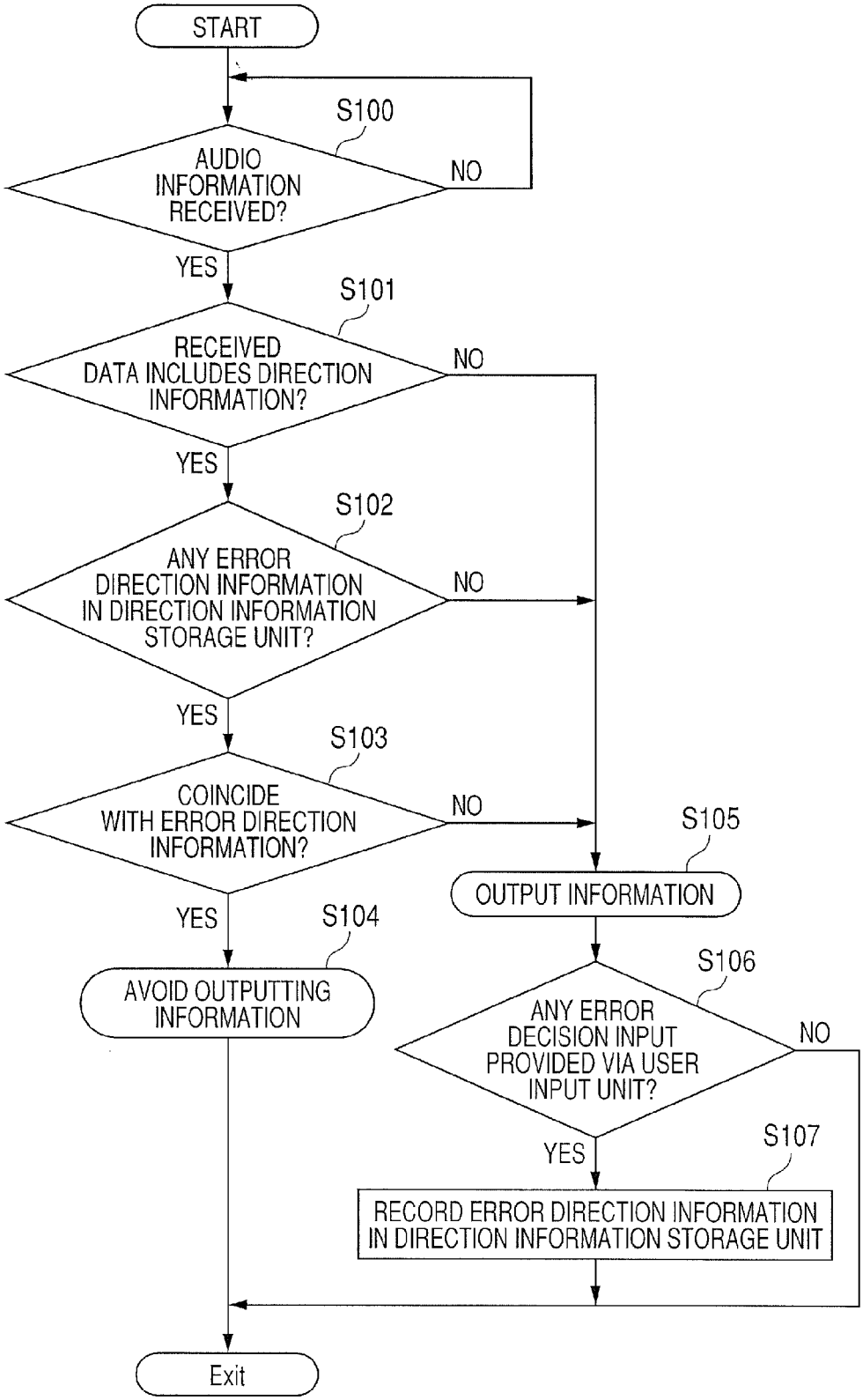
FIG. 8 is a flowchart of a first utterance decision process executed by the utterance type vehicle-mounted device shown in FIG. 1.

Now, a first utterance acceptability decision process executed by the utterance type vehicle-mounted device 200 according to the embodiment of the present invention will be specifically described. FIG. 8 is a flowchart of the first utterance determination process executed by the utterance type vehicle-mounted device 200 shown in FIG. 1. In the first utterance acceptability determination process, control is performed as follows. If the utterance is false, the driver provides, via the user input unit 255, an input indicating that the audio information is false. The error direction information is stored. Thus, audio information not directed to the own vehicle is prevented from being outputted depending on whether or not direction information added to subsequently received audio information coincides with the error direction information. This will be specifically described below.

The utterance type vehicle-mounted device 200 is powered on (START) to receive information D including audio information from the roadside apparatus 100. The utterance type vehicle-mounted device 200 decides whether or not audio information has been received (step S100). The utterance type vehicle-mounted device 200 repeats the decision in step S100 until audio information is received. If audio information is received (Yes), the utterance type vehicle-mounted device 200 decides whether or not the received audio information includes direction information (step S101). If the received information includes direction information (Yes), the utterance type vehicle-mounted device 200 decides whether or not any error direction information is recorded in the direction information storage unit 256 (step S102). If any error direction information is recorded in the direction information storage unit 256 (Yes), the utterance type vehicle-mounted device 200 decides whether or not the error direction information coincides with the direction information included in the received audio information (step S103). If the error direction information coincides with the direction information included in the received audio information (Yes), the utterance type vehicle-mounted device 200 does not output the audio information (step S104). If the received audio information includes no direction information (No in step S101), if no error direction information is recorded in the direction information storage unit 256 (No in step S122), or if the error direction information fails to coincide with the direction information included in the received audio information (No in step S103), the utterance type vehicle-mounted device 200 outputs the audio information (step S105). The utterance type vehicle-mounted device 200 decides whether or not a decision input indicating that the direction information is false is received from the user input unit 255 after step S105 (step S106). Upon receiving an input indicating that the direction information is false (Yes) from the user input unit 255 after step S105, the utterance type vehicle-mounted device 200 records the error direction information in the direction information storage unit 256 (step S107). When no decision input indicating the direction information is false is received from the user input unit 255 after step S105 (No) and when step S107 is completed, the utterance type vehicle-mounted device 200 terminates the first utterance acceptability decision process (Exit).

The decision control process as described above enables the following control to be performed simply by the driver's pre-provision, via the user input unit 255, of an input indicating that the utterance is false: audio information not directed to the own vehicle is prevented from being outputted by acquiring error direction information required to determine the audio information not directed to the own vehicle and then comparing the error direction information with the direction information included in the received information. Furthermore, with this configuration, even upon receiving audio information provided for a direction different from the vehicle traveling direction, from the roadside apparatus 100, the utterance type vehicle-mounted device 200 is prevented from outputting error traffic information or the like even without the use of position information on the vehicle or position information on the roadside apparatus. This reduces the risk that the driving of the vehicle is affected as a result of the driver hearing error traffic information or the like. If information coinciding with the error direction information is received in step S103 described above, the utterance type vehicle-mounted device 200 may additionally execute a process of providing an alert message, for example, "you may be driving in the wrong lane". The utterance type vehicle-mounted device 200 may thus detect that the vehicle is traveling in the wrong lane to warn the driver of this.

(Description of a Second Utterance Acceptability Decision Process)

Figure 9:
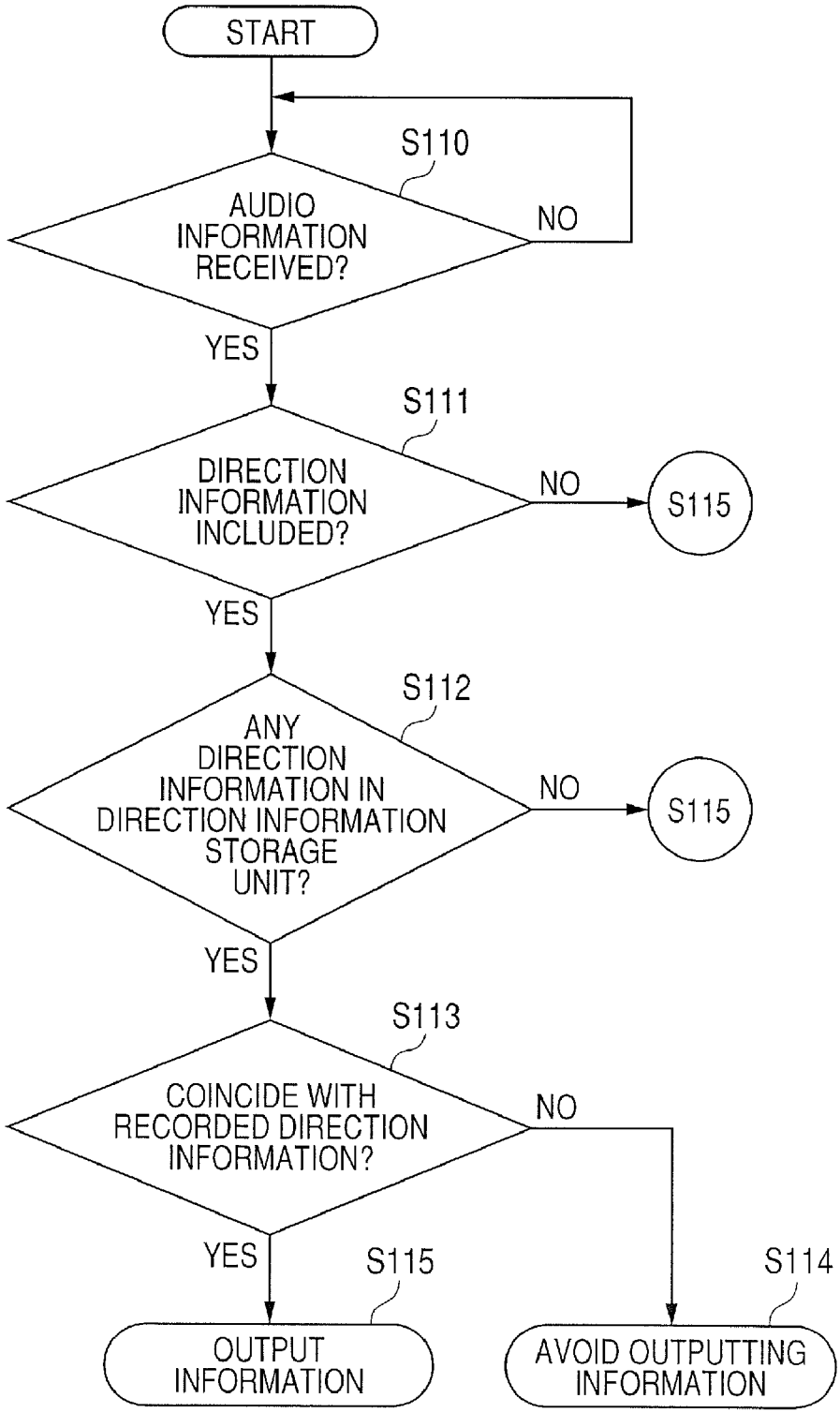
FIG. 9 is a flowchart of a second utterance decision process executed by the utterance type vehicle-mounted device shown in FIG. 1.
Figure 10:
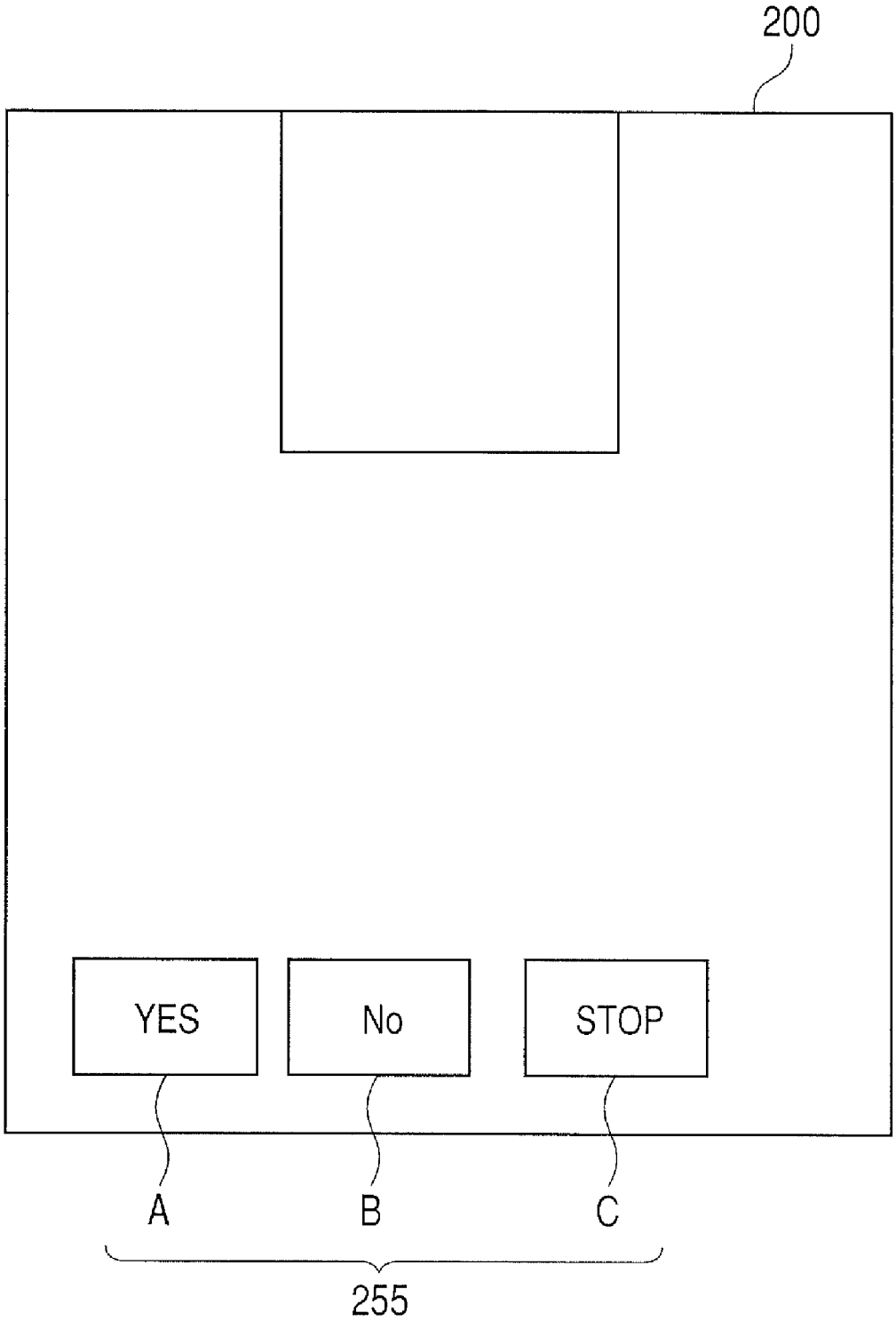
FIG. 10 is a diagram showing a second configuration example of the user input unit shown in FIG. 5.

Now, a second utterance acceptability decision process executed by the utterance type vehicle-mounted device will be described. FIG. 9 is a flowchart of the second utterance acceptability decision process executed by the utterance type vehicle-mounted device 200 shown in FIG. 1. In the second utterance acceptability decision process, the following control is performed. The decision input from the user input unit 255 is accepted not only when a false utterance is provided but also when the true utterance is provided. The corresponding direction information is stored. Then, whether or not the audio information is directed to the own vehicle is decided depending on whether or not the stored direction information coincides with direction information added to subsequently received audio information. Unlike in the case of the first utterance acceptability decision process, the utterance type vehicle-mounted device 200 includes the user input unit 255 as shown in FIG. 10. FIG. 10 is a diagram showing a second configuration example of the user input unit 255 shown in FIG. 5. In the present embodiment, the driver provides:

a decision input (A) indicating that the information is to be provided for the same direction as the vehicle traveling direction, or a decision input (B) indicating that the information is to be provided for a direction different from the vehicle traveling direction. As shown in FIG. 10, the utterance type vehicle-mounted device 200 includes a user input button A belonging to the user input unit 255 and functioning as the decision input (A) and a user input button B belonging to the user input unit 255 and functioning as the decision input (B). One of these buttons is depressed to provide the corresponding decision input. Alternatively, the decision input (A) may be determined to have been provided if neither of the buttons is depressed within a predetermined time. A specific description will be given below. As shown in FIG. 10, the user input unit 255 includes a user input button C configured so as to notify the information production unit 253 of the above-described result to forcibly terminate the utterance of the audio information.

Now, the second utterance acceptability decision process will be described. In the flowchart shown in FIG. 9, it is assumed that the user input button A has been depressed, with the "true" direction information recorded in the direction information storage unit 256.

The utterance type vehicle-mounted device 200 is powered on (START) to receive information D including audio information from the roadside apparatus 100. The utterance type vehicle-mounted device 200 decides whether or not audio information has been received (step S110). The utterance type vehicle-mounted device 200 repeats the decision in step S110 until audio information is received. If audio information is received (Yes), the utterance type vehicle-mounted device 200 decides whether or not the received audio information includes direction information (step S111). If the received information includes direction information (Yes), the utterance type vehicle-mounted device 200 decides whether or not any direction information is recorded in the direction information storage unit 256 (step S112). In this case, no initial value is set for the direction information recorded in the direction information storage unit 256. The first audio information outputted after the utterance type vehicle-mounted device 200 has been powered on is recorded as direction information indicative of the traveling direction of the own vehicle. Then, a process of controlling direction information as described below is executed to record and update the direction information.

If any direction information is recorded in the direction information storage unit 256 (Yes), the utterance type vehicle-mounted device 200 decides whether or not the recorded direction information coincides with the direction information included in the received audio information (step S113). If the direction information recorded in the direction information storage unit 256 fails to coincide with the direction information included in the received audio information (No), the utterance type vehicle-mounted device 200 avoids outputting the audio information (step S114).

If the received audio information includes no direction information (No in step S111), if no direction information is recorded in the direction information storage unit 256 (No in step S112), or if the recorded direction information coincides with the direction information included in the received audio information (Yes in step S113), the utterance type vehicle-mounted device 200 outputs the audio information (step S115).

In the description of step S113, the direction information recorded in the direction information storage unit 256 is associated with the input so as to correspond to the "true" direction information indicative of the same direction as the traveling direction of the own vehicle (for example, the user input button A has been depressed). If the direction information recorded in the direction information storage unit 256 is associated with the input so as to correspond to the "error" direction information indicative of a direction different from the traveling direction of the own vehicle (for example, if the user input button B has been depressed), then in the processing in the subsequent steps S114 and S115, the utterance type vehicle-mounted device 200 decides whether or not the "error" direction information coincides with direction information included in the received audio information. Thus, the opposite processing is executed.

Furthermore, if in the above-described step S113, information not coinciding with the direction information recorded in the direction information storage unit 256 is consecutively received in a short time, the utterance type vehicle-mounted device 200 may additionally execute a process of providing an alert message, for example, "you may be driving in the wrong lane". The utterance type vehicle-mounted device 200 may thus detect that the vehicle is traveling in the wrong lane to warn the driver of this.

(Description of a First Control Process for the Direction Information)

Figure 11:
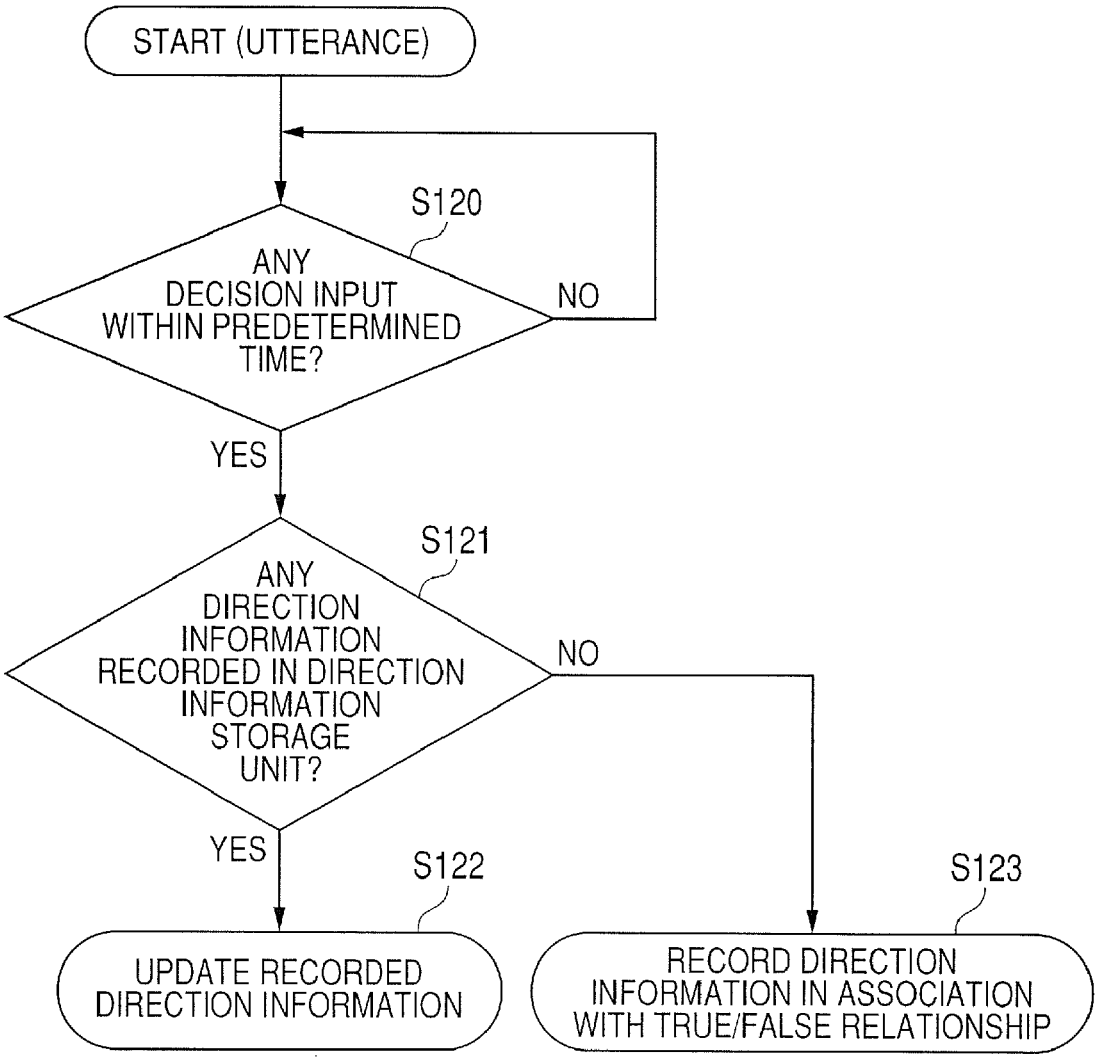
FIG. 11 is a flowchart of a first control process executed on direction information used for the second utterance decision process shown in FIG. 9.

Now, a first control process for the direction information used for the second utterance acceptability decision process shown in FIG. 9 will be specifically described with reference to FIG. 11. FIG. 11 is a flowchart of the first control process for the direction information used for the second utterance acceptability decision process shown in FIG. 9. The first control process serves to prevent a plurality of pieces of audio information with different types of direction information added thereto from being disadvantageously consecutively received in a short time. The control process is specifically as follows. It is assumed that two pieces of audio information (the first piece of audio information is referred to as the audio information X, and the second piece of audio information is referred to as the audio information Y) with different types of direction information added thereto are received. Then, the output of the audio information X is completed, and immediately after the completion, the audio information Y is outputted. The user input unit 255 is then depressed while the audio information Y is being outputted. The control process then clearly determines with which of the audio information X and the audio information Y the input is associated.

When an utterance (audio output) is started (START), the utterance type vehicle-mounted device 200 decides whether or not any decision input has been provided via the user input unit 255 within a predetermined time (step S120). Specifically, the utterance type vehicle-mounted device 200 decides whether the above-described user input button A or B has been depressed.

Upon receiving a notification from the user input unit 255 within a predetermined time after the audio output is started (Yes), the utterance type vehicle-mounted device 200 decides whether or not any direction information is recorded in the direction information storage unit 256 (step S121). Here, the utterance type vehicle-mounted device 200 decides whether or not any direction information is recorded in the direction information storage unit 256 and does not determine the content of the distance information. In step S121, if any direction information is recorded in the direction information storage unit 256 (Yes), the utterance type vehicle-mounted device 200 updates the direction information (step S122). In step S121, if no direction information is recorded in the direction information storage unit 256 (No), the utterance type vehicle-mounted device 200 records direction information in association with a true/false relationship (information directed to the own vehicle=true and information for a different direction=false) (step S123).

The first control process for the direction information as described above not only exerts the same effects of above-described second utterance acceptability decision process but also allows the process of recording and updating the direction information to be executed within a limited predetermined time. Thus, the direction information corresponding to the received audio information can be closely associated with the direction information inputted via the user input unit 255 in terms of the true/false relationship. Thus, even if audio information is consecutively received within a short time, the audio information not directed to the own vehicle can be reliably distinguished from the audio information directed to the own vehicle. This enables error traffic information and the like to be prevented from being outputted as voice. Here, "within the predetermined time" refers to, for example, at most 15 seconds after the start of an audio output, at most 10 seconds after completion of the output, or the amount of time until the start of the next audio output. The utterance type vehicle-mounted device 200 may be specified to allow the driver to optionally set the predetermined time.

(Description of a Second Control Process for the Direction Information)

Figure 12:
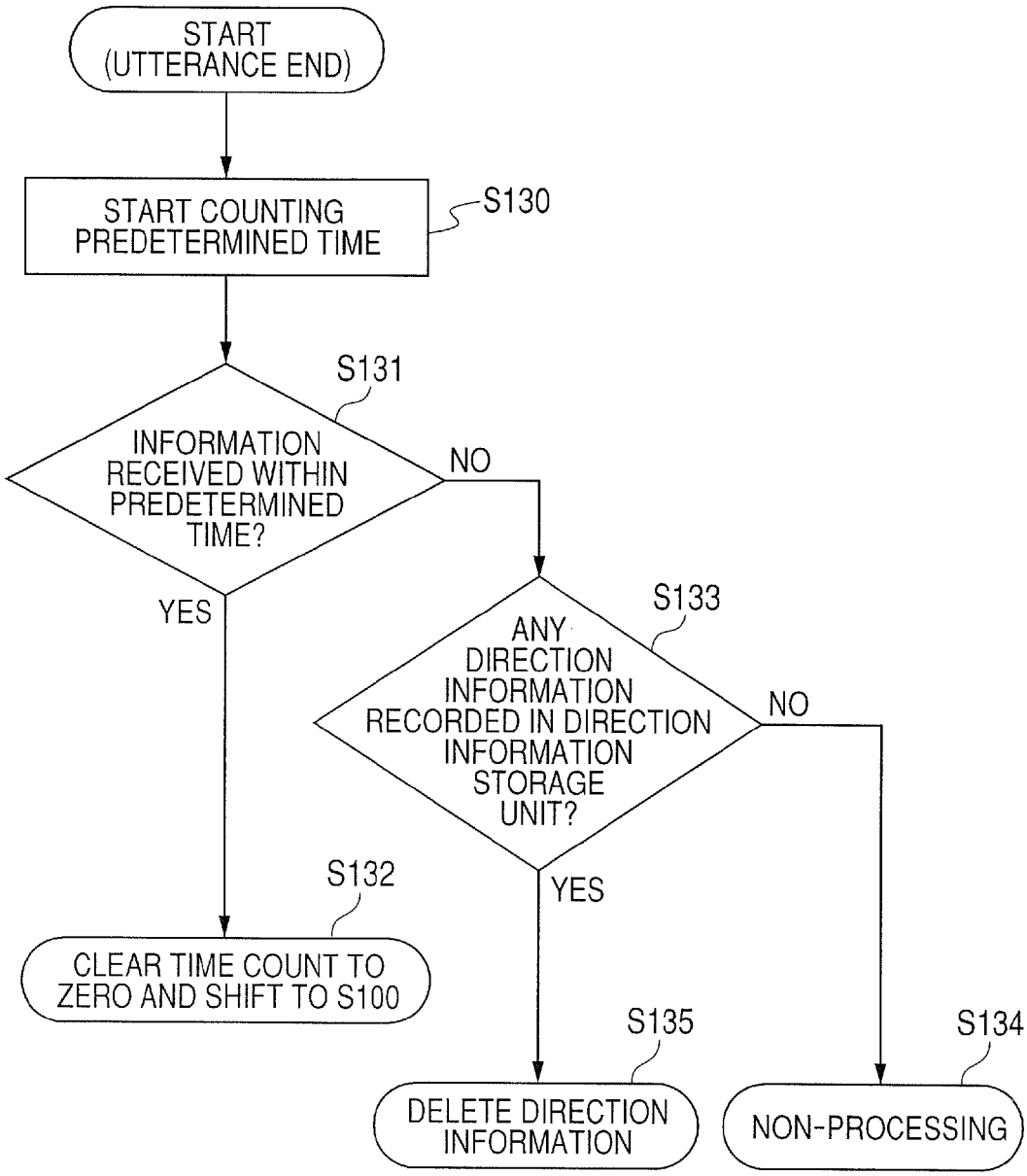
FIG. 12 is a flowchart of a second control process executed on the direction information used for the second utterance decision process shown in FIG. 9.

Now, a second control process for the second utterance acceptability decision process shown in FIG. 9 will be specifically described with reference to FIG. 12. FIG. 12 is a flowchart of the second control process for the direction information used for the second utterance acceptability decision process shown in FIG. 9. The second control process serves to prevent the recorded direction information from disadvantageously remaining as the vehicle traveling direction for a long time.

When utterance processing is completed (START), the utterance type vehicle-mounted device 200 counts a predetermined time (step S130). The utterance type vehicle-mounted device 200 then decides whether or not new information has been received within a predetermined time after the completion of the last utterance processing (step S131).

If new information has been received within the predetermined time (Yes), the utterance type vehicle-mounted device 200 clears the time count to zero at the time of the reception (step S132). Then, if new information has been received, the utterance type vehicle-mounted device 200 simultaneously executes the process in step S100 shown in FIG. 8 (step S132).

In step S131, if no new information has been received within the predetermined time, the utterance type vehicle-mounted device 200 decides whether or not any direction information is recorded in the direction information storage unit 256 (step S133). In step S133, if no direction information is recorded in the direction information storage unit 256 (No), the utterance type vehicle-mounted device 200 executes no processing (step S134). In step S133, if any direction information is recorded in the direction information storage unit 256 (Yes), the utterance type vehicle-mounted device 200 deletes the direction information recorded in the direction information storage unit 256 (step S135). The predetermined time as used herein may be, for example, in the case of an expressway, between 4 minutes and 5 minutes or between 10 minutes and 20 minutes. Alternatively, the utterance type vehicle-mounted device 200 may be specified to allow the driver to set the predetermined time.

Alternatively, the control may be such that powering off the utterance type vehicle-mounted device 200 allows the direction information to be deleted (cleared). Such control exerts the following effect. For example, when a vehicle with the utterance type vehicle-mounted device 200 mounted therein is parked in a multi-level parking facility where the vehicle is rotated for parking, even if the vehicle travels in a different direction around the time of the parking, the utterance acceptability decision process is prevented from being executed based on error direction information. Moreover, such a situation is expected to occur when the vehicle travels on a general road. Thus, the utterance type vehicle-mounted device 200 may include a control button configured to allow the driver to selectively determine whether or not to perform the above-described control. Alternatively, if the history of ETC toll settlement information is saved to the storage device 216 of the utterance type vehicle-mounted device 200, the history information may be used to decide whether the vehicle is now traveling on a general road or an expressway so that the utterance type vehicle-mounted device 200 can automatically perform control.

The second control process for the direction information as described above not only exerts the same effects of the above-described first or second utterance acceptability decision process and of the first control process for the direction information but also prevents the following problem: when the recorded direction information remains as the vehicle traveling direction for a long time, even if the vehicle travels normally in a different direction, the vehicle is decided to travel in the wrong lane.

The embodiment of the present invention has been described. However, various changes may be made to the embodiment without departing from the spirits of the present invention. For example, in the description of the present embodiment, it is assumed that the roadside apparatus 100 divides the audio information into pieces before transmission. However, undivided information may be transmitted to the utterance type vehicle-mounted device 200. Furthermore, the user input buttons A, B, C, and F are illustrated as the user input unit 255. However, another input means such as audio input may be adopted.

The above-described road communication system is preferably applied to an expressway but is applicable to all roads.

Furthermore, the short range communication system called DSRC has been described as an example of a communication scheme. However, the road communication system is also applicable to a wideband communication scheme. Additionally, the utterance type vehicle-mounted device 200 with no GPS function has been illustrated. However, the present invention is applicable to a vehicle-mounted device (for example, a portable, simplified navigation apparatus including no acceleration sensor and no vehicle speed pulse) that cannot acquire position information or direction information on the own vehicle from an apparatus with a GPS function, a vehicle-mounted device connected to a navigation apparatus that can acquire direction information, and an ETC vehicle-mounted device. Furthermore, the utterance type vehicle-mounted device 200 with the information reproduction unit 253 (information output unit) has been illustrated. However, the information output unit of the utterance type vehicle-mounted device 200 may be connected to a car audio system or the like so as to output audio information received from the roadside apparatus 100 utilizing an audio reproduction unit of the car audio system or the like.

Furthermore, the above-described system includes the information provision server 300. However, information stored in and transmitted to the roadside apparatus 100 may be received from a storage medium such as a CD or a DVD rather than from another server and may be transmitted through a broadcasting network.

Additionally, in the above-described embodiment, the utterance type vehicle-mounted device 200 mounted in the vehicle has been described as an example of information reception means. However, a communication terminal such as a portable personal computer or a cellular phone may be mounted in the vehicle so as to be operative. Moreover, in the above-described embodiment, the functions of the roadside apparatus 100 and the utterance type vehicle-mounted device 200 are specified for the respective particular pieces of hardware, which thus serve as corresponding functional means. However, all or some of the functional means may be processed and executed by software including programs.

INDUSTRIAL APPLICABILITY

The present invention is applicable to all road traffic systems. The present invention can be utilized particularly for a utterance type vehicle-mounted device, a road communication system, and a program.

The invention claimed is:

1. A vehicle-mounted device mounted in a vehicle traveling on a road and comprising a communication processing unit configured to receive information from a roadside apparatus installed on the road, and an information output unit configured to output the information received by the communication processing unit, wherein the vehicle-mounted device further comprises a user input unit configured such that if information received from the roadside apparatus and outputted through the information output unit is to be provided for a same direction as a vehicle traveling direction or for a direction different from the vehicle traveling direction, the user input unit is used to provide an input indicating that the information received from the roadside apparatus and outputted through the information output unit is to be provided for the same direction as the vehicle traveling direction or for the direction different from the traveling direction.

2. The vehicle-mounted device according to claim 1, wherein after the information output unit outputs the received information, the user input unit receives within a predetermined time, a decision input (A) indicating that the information is to be provided for the same direction as the vehicle traveling direction, or a decision input (B) indicating that the information is to be provided for a direction different from the vehicle traveling direction, and when the decision input (A) is received within the predetermined time or when no decision input is received within the predetermined time, the vehicle-mounted device decides that the input corresponds to (A), and when the decision input (B) is received within the predetermined time, the vehicle-mounted device decides that the input corresponds to (B).

3. The vehicle-mounted device according to claim 1, wherein when the received information includes no direction information, the received information is directly outputted through the information output unit without determination of the direction information.

4. The vehicle-mounted device according to claim 1, further comprising:

a direction information determination unit configured to associate direction information provided via the user input unit with direction information included in the received information to determine the vehicle traveling direction;

a direction information storage unit configured such that the direction information determined by the direction information determination unit is recorded in the direction information storage unit; and an output acceptability determination unit configured such that depending on whether or not the direction information recorded in the direction information storage unit coincides with direction information included in information received after the recording of the direction information in the direction information storage unit, the output acceptability determination unit decides whether or not to output the received information through the information output unit.

5. The vehicle-mounted device according to claim 4, wherein after the information output unit outputs the received information, the user input unit receives within a predetermined time, a decision input (A) indicating that the information is to be provided for the same direction as the vehicle traveling direction, or a decision input (B) indicating that the information is to be provided for a direction different from the vehicle traveling direction, and when the decision input (A) is received within the predetermined time or when no decision input is received within the predetermined time, the vehicle-mounted device decides that the input corresponds to (A), and when the decision input (B) is received within the predetermined time, the vehicle-mounted device decides that the input corresponds to (B).

6. The vehicle-mounted device according to claim 5, wherein when the received information includes no direction information, the received information is directly outputted through the information output unit without determination of the direction information.

7. The vehicle-mounted device according to claim 4, wherein when no information or no decision input is received within a predetermined time from the last information reception, the direction information determination unit deletes the direction information recorded in the direction information storage unit.

8. The vehicle-mounted device according to claim 4, wherein when no direction information is recorded in the direction information storage unit, the received information is directly outputted through the information output unit.

9. The vehicle-mounted device according to any one of claims 1 to 8, wherein the vehicle-mounted device is an utterance type vehicle-mounted device incapable of acquiring vehicle position information from a GPS apparatus or a vehicle speed sensor.

10. An output acceptability decision method used for a vehicle-mounted device mounted in a vehicle traveling on a road and including a communication processing unit configured to receive information from a roadside apparatus installed on the road, and an information output unit configured to output the information received by the communication processing unit, the output acceptability decision method comprising the steps of: receiving an input indicating that the information received from the roadside apparatus and then outputted is to be provided for a same direction as a vehicle traveling direction or for a direction different from the traveling direction; associating an input direction with direction information included in the received information to determine the vehicle traveling direction; recording the determined direction information; and depending on whether or not the recorded direction information coincides with direction information included in information received after the recording of the direction information, deciding whether or not to output the information received after the recording of the direction information.

11. A road communication system comprising a vehicle-mounted device mounted in a vehicle, a roadside apparatus configured to transmit information including direction information to the vehicle-mounted device, and an information provision server configured to transmit the information including the direction information to the roadside apparatus, wherein the vehicle-mounted device comprises: a communication processing unit configured to receive information from the roadside apparatus; an information output unit configured to output the information received by the communication processing unit; a user input unit configured such that if the information outputted through the information output unit is to be provided for a same direction as a vehicle traveling direction or for a direction different from the vehicle traveling direction, the user input unit is used to provide an input indicating that the information received from the roadside apparatus and outputted through the information output unit is to be provided for the same direction as the vehicle traveling direction or for the direction different from the traveling direction; a direction information determination unit configured to associate direction information provided via the user input unit with direction information included in the received information to determine the vehicle traveling direction; a direction information storage unit configured such that the direction information determined by the direction information determination unit is recorded in the direction information storage unit; and an output acceptability determination unit configured such that depending on whether or not the direction information recorded in the direction information storage unit coincides with direction information included in information received after the recording of the direction information in the direction information storage unit, the output acceptability determination unit decides whether or not to output the information received after the recording of the direction information in the direction information storage unit, through the information output unit.

12. A non-transitory computer-readable medium which stores a program for causing a computer to function as the vehicle-mounted device according to any one of claims 1 to 8.

* * * * *